US005969312A

United States Patent [19]

Svetlik et al.

[11] Patent Number: 5,969,312

[45] Date of Patent: Oct. 19, 1999

[54] AMBIDEXTROUS POWERS-SWITCH LOCK-OUT MECHANISM

[75] Inventors: Kenneth N. Svetlik, Schaumburg; Joseph Z. Wascow, Hawthorn Woods, both of Ill.

[73] Assignee: S-B Power Tool Company, Carol Stream, Ill.

[21] Appl. No.: 09/103,380

[22] Filed: Jun. 24, 1998

[51] Int. Cl.[6] ..... H01H 9/20

[52] U.S. Cl. ..... 200/61.85; 200/43.17; 200/318; 200/334; 83/DIG. 1

[58] Field of Search ..... 83/471.2, 471.3, 83/490, 523, 701, DIG. 1; 30/381, 382, 388, 390; 16/110 R, 111 R; 200/522, 43.17, 518, 61.85, 318–327, 332.2, 334, 50.1, 50.01

[56] References Cited

U.S. PATENT DOCUMENTS

| | | | |
|---|---|---|---|
| 3,331,406 | 7/1967 | Christophel | 83/471.3 |
| 3,746,815 | 7/1973 | Drummer | 200/157 |
| 3,873,796 | 3/1975 | Worobec, Jr. | 200/157 |
| 4,122,320 | 10/1978 | Edgell et al. | 200/157 |
| 4,277,666 | 7/1981 | Vignaud | 200/328 |
| 4,900,881 | 2/1990 | Fischer | 200/61.85 |
| 5,005,295 | 4/1991 | Fushiya | 83/DIG. 1 X |
| 5,233,945 | 8/1993 | Wolf et al. | 30/381 X |
| 5,310,259 | 5/1994 | Wanat | 366/349 |
| 5,440,089 | 8/1995 | Prokop | 200/321 |
| 5,483,727 | 1/1996 | Chang | 83/471.3 X |
| 5,570,512 | 11/1996 | Hoppner | 30/383 |
| 5,577,600 | 11/1996 | Schoene et al. | 200/43.17 |
| 5,681,214 | 10/1997 | Kleider et al. | 451/358 |
| 5,778,747 | 7/1998 | Chen | 83/471.3 |

*Primary Examiner*—Rinaldi I. Rada
*Assistant Examiner*—Ana Luna
*Attorney, Agent, or Firm*—Gardner, Carton & Douglas

[57] ABSTRACT

The invention is a novel power tool with an ambidextrous lock-out mechanism to prevent unintended actuation of a power switch operatively associated with a motor that operates the power tool. The lock-out mechanism has a first unlocking means located to be conveniently operated by the thumb of a right hand and a second actuating means located to be conveniently operated by the thumb of a left hand, both of said first and second unlocking means capable of unlocking the power switch by inactuating the power switch lock mechanism in order to release the power switch and allow operation of the power tool.

9 Claims, 3 Drawing Sheets

AMBIDEXTROUS POWERS-SWITCH LOCK-OUT MECHANISM

FIELD OF THE INVENTION

The invention relates in general to power tools, and, in particular to a power tool with an ambidextrous lock-out mechanism for use with lockable power switches.

BACKGROUND OF THE INVENTION

Lock-out mechanisms for lockable power switches are known in the art. These mechanisms are intended to unlock the locked power switch or trigger of a motor driven tool or machine in order to allow the actuation of the motor by the power switch. The power switch of many power tools such as circular saws, table saws of various sorts, hedge trimmers and the like is provided with a lock mechanism in order to prevent unintended operation of a power tool or machine through inadvertent actuation of the power switch prior to operation of the power tool or machine. The user is required to actuate the lock-out mechanism in order to bring the lock mechanism of the power switch in an unlocked position in which the power switch can be depressed and, accordingly, the motor can be actuated.

In an electrically powered miter saw, for instance, used here for example only and not by way of limitation, a motor is used to power a circular saw blade mounted on an cantilevered arm. A platform including guides is also provided. The blade has a housing which covers the unused area of the blade. In this example, as in many power tools, a handle is attached to extend above or besides the blade for convenient operation of the saw, and on the handle is installed a power lever or switch which can be of the trigger-switch variety.

When using the saw, the user is often required to hold the item to be sawed with one hand, and to subsequently raise and lower the saw blade with the other hand. For example, in order to make a mitered cut in a length of wood trim, the user first positions the wood on a platform located below the blade. The user then turns the machine power on by grasping the handle and squeezing or depressing the power lever switch. Without removing the hand from the handle, the user then lowers the saw blade down onto the trim while holding the work piece on the platform with the other hand in order to make the desired cuts. Once cutting is complete, without removing the hand from the handle, the user raises the handle and turns off the saw by releasing the power switch. After release the power switch moves back to its rest position in which the motor is inactuated.

In many power tools including saws, the power switch will be locked by lock means as soon as it comes into its rest position for security reasons. If locked, the power switch cannot be moved into the actuation position in which the motor starts turning. To operate the tool or machine, the user has to actuate the lock-out means first in order to release the power switch.

Many of the prior art lock-out mechanisms, however, are designed for the right-handed individual. In an embodiment with a grip handle arranged in a substantially horizontal manner the lock-out mechanism is positioned left to the power switch. In this case the mechanisms involve intended movement of the right thumb in order to actuate the lock-out mechanism. Left-handed operators, however, must either use both hands for unlocking and depressing the power switch, or they must inconveniently use their right hand for operation of the saw. Thus, left-handed operators are unable to realize the same ergonomic benefits from the lock-out mechanisms as do right-handed operators.

SUMMARY OF THE INVENTION

The invention is a novel power tool with an ambidextrous lock-out mechanism that allows to be conveniently operated both by a right-handed and a left-handed operator. The lockout mechanism has a first unlocking means located to be conveniently operated by the thumb of a right hand and a second actuating means located to be conveniently operated by the thumb of a left hand, either means of which is capable of unlocking the lock means locking the power switch in its inactivated position. Also claimed is a handle having a power switch lock-out mechanism according to the invention.

It is an object of the invention to provide an ambidextrous lock-out mechanism for the power switch of a power tool.

It is another object of the invention to provide a lock-out mechanism with a dual actuator positioned so that either a left or a right-handed operator can use the mechanism with equal facility.

Other objects and advantages will be apparent from reading the accompanying description and by reference to the claims. Throughout the following description, reference numbers refer to like parts.

DETAILED DESCRIPTION OF THE INVENTION

While the invention will be described in connection with a preferred embodiment, it will be understood that we do not intend to limit the invention to this embodiment. On the contrary, we intend to cover all alternatives, modifications and equivalents as may be included within the spirit and scope of the invention.

Figure 1:
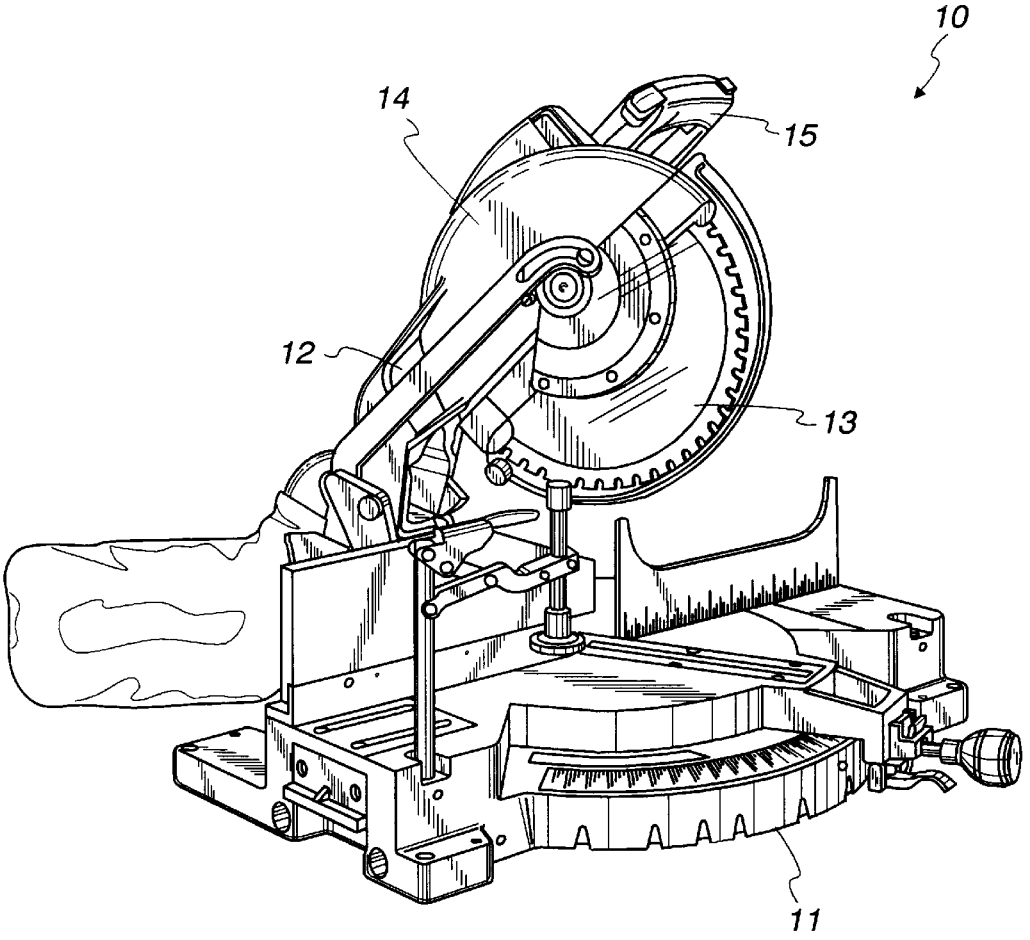
FIG. 1 is a miter saw as an example for any power tool having a handle constructed with the principles of the invention.

Turning now to the drawings, a miter saw 10 having a lock-out mechanism in accordance with the principles of the invention is shown in FIG. 1 and comprises a platform 11, a cantilevered arm 12, a blade 13, a blade housing 14 and a handle 15.

Figure 2:
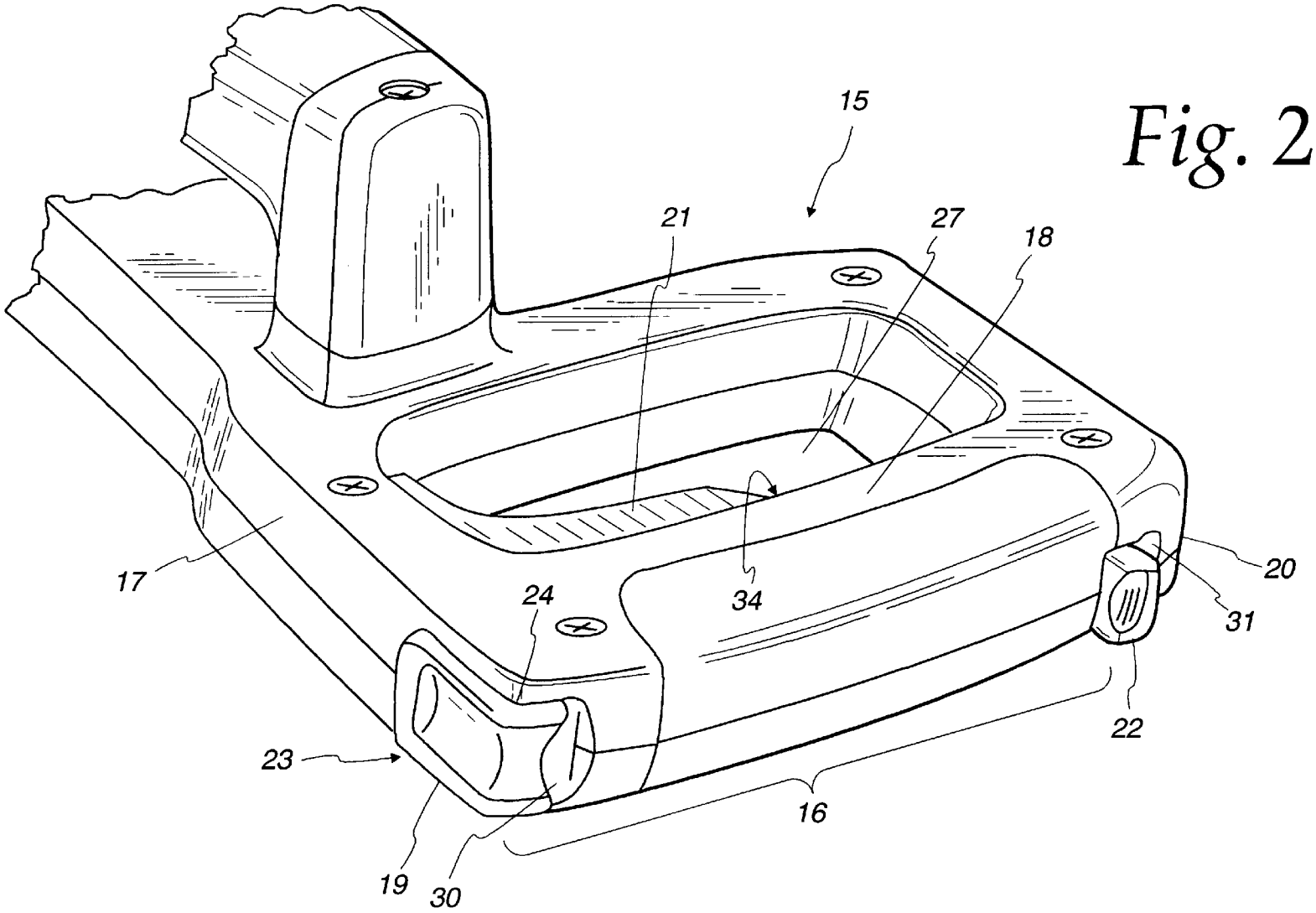
FIG. 2 is a fragmentary isometric view of a handle housing having an ambidextrous lock-out mechanism of the invention.

The handle 15 constructed in accordance with the principles of the invention is shown in FIG. 2, and includes an ambidextrous power switch lock-out mechanism 16. In the particular embodiment for the miter saw 10 illustrated in FIG. 1, the handle 15 has a housing 17 comprising a first 19 and a second side 20. A grip means 18 is connecting first and second sides 19, 20. The handle 15 comprises an opening 27 through which fingers may extend to firmly grasp the handle 15 during operation of the miter saw 10. On an inner side 29 of said handle 15 the housing 17 has a first window 34, better shown in FIG. 3, through which a trigger 21 of a power switch mechanism 26 partly protrudes into said opening 27.

When looking on the handle 15 from behind, as it is shown in FIG. 2, a second window 30 is located left of the trigger 21 in said first side 19 of the housing 17 extending over a corner 24 to the grip means 18 of the handle 15. A right thumb pressure button 23 protrudes through said second window 30. A third window 31 is provided right of the trigger 21 in the grip means 18 nearby the second side 20. A left thumb slide button 22 protrudes through said third window 31.

Figure 3:
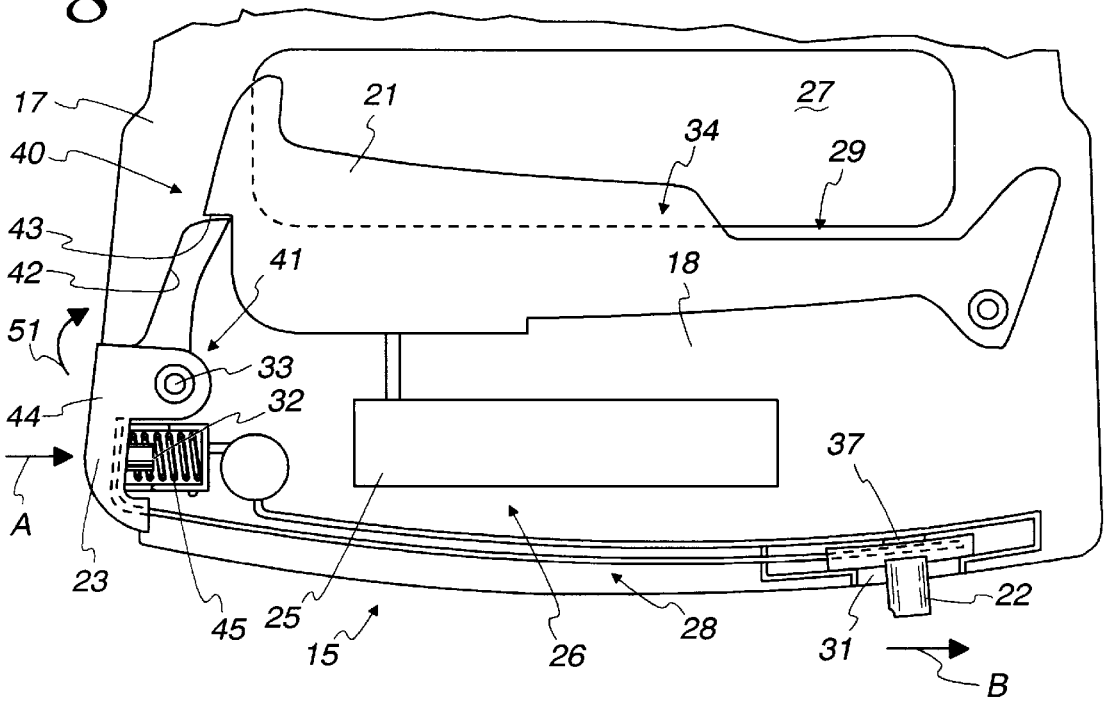
FIG. 3 is a fragmentary plan view of a lock-out mechanism of the invention.
Figure 4:
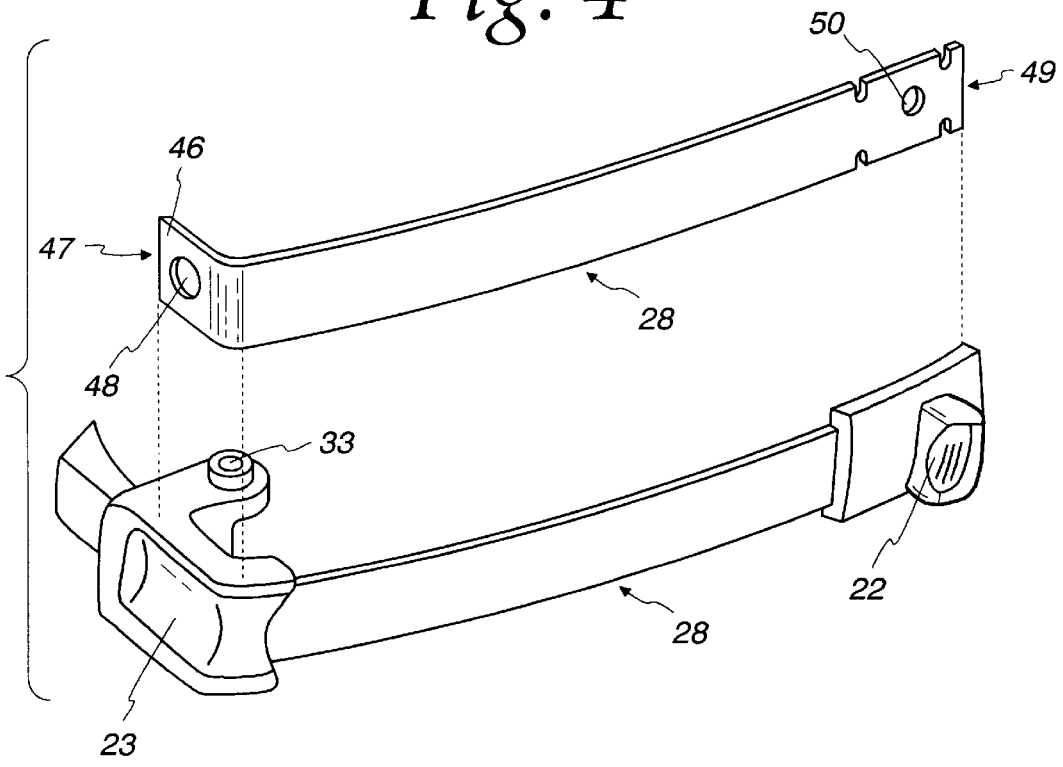
FIG. 4 is an exploded view of the lock-out mechanism of the invention.

As it is shown in FIG. 3, the trigger 21 is pivotally mounted in the housing 17 and corresponds with a control switch 25 of the power switch mechanism 26 for controlling the motor of the miter saw 10. A power switch lock mechanism 40 comprising a lever 41 pivotally mounted around a axle 33 engages the trigger 21 with a first arm 42. The first arm 42 interferes with a step 43 on the trigger 21. A biasing means 45, for example accomplished by a spring, located in said housing 17 abuts against said second arm 44 and causes a moment on the lever 41 in direction of arrow 51, thus keeping first arm 42 and trigger 21 engaged. Therefore, lever 41, trigger 21 and spring 45 accomplish a power switch lock mechanism 40 securing the power switch 26 in its inoperable position. The lever 41 has a second arm 44 forming said pressure button 23 representing a first unlocking means.

A second unlocking means is being represented by said slide button 22 protruding through said third window 31. The slide button 22 is connected to said second arm 44 of the lever 41 by means of a bracket member 28.

The bracket member 28 is located within the housing 17. The bracket member 28 is L-shaped having a leg 46 extending from a first end 47, which leg 46 includes a first through hole 48 for mounting to said second arm 44. The bracket member 28 further includes a second end 49 and a second through hole 50 for mounting to said slide button 22 by pin 37.

The ambidextrous lock-out mechanism according to the invention functions as follows: In the described embodiment the grip means 18 extends substantially in a horizontal plane. For use of the miter saw 10 the power switch 26 will be secured by the power switch lock mechanism. To operate the miter saw 10 the user grasps the grip means 18 with his fingers protruding into the opening 27. For starting the motor the user either presses down the pressure button 23 in direction of arrow A or pushes the slide button 23 in direction of arrow B with his thumb. A right handed user will conveniently use his right thumb to press down the pressure button 23 whereas a left handed user will conveniently use his left thumb to push the slide button 22. Both actions will cause the release of the trigger 21 as soon as the first arm 42 of the lever 41 will be disengaged with the trigger 21 by pivoting the lever 41 against direction of arrow 51 and the force of the spring 45.

It should be understood that various changes and modifications to the preferred embodiment described here will be apparent to those skilled in the art. Such changes and modifications can be made without departing from the spirit and scope of the present invention and without diminishing its attendant advantages. It is therefore intended that such changes and modifications be covered by the appended claims.

We claim:

1. A power tool having a lock-out mechanism for unlocking a power switch operatively associated with a motor that operates the power tool wherein the lock-out mechanism is ambidextrously used by an operator, the power tool comprising:

a power switch lock mechanism for securing the power switch in a locked position in order to prevent unintended actuation of the power switch:

a first unlocking means located on the lock-out mechanism to be conveniently operated by a right hand of the operator; and a second unlocking means located on the lock-out mechanism to be conveniently operated by a left hand of the operator;

both of said first and second unlocking means capable of unlocking the power switch by inactuating the power switch lock mechanism in order to release the power switch and allow operation of the power tool.

2. The power tool according to claim 1 further comprising:

a housing forming a handle; said housing accommodating the power switch and the power switch lock mechanism;

a first window in said housing for the power switch;

a second window in said housing for said first unlocking means; and a third window in said housing for said second unlocking means.

3. The power tool according to claim 2 wherein:

the power switch lock mechanism comprises a lever pivotally mounted in said housing around an axle;

said lever having a first arm for engaging and fixing of a trigger of the power switch;

said lever having a second arm; and a biasing means abutting against said lever in such manner that said first arm comes into engagement with said trigger for locking the power switch in said locked position.

4. The power tool according to claim 3 wherein:

said first unlocking means is comprising a first button connected to said second arm of said lever; and said second unlocking means is comprising a second button connected to said second arm of said lever.

5. The power tool according to claim 4 wherein:

said first button is a pressure button formed by said second arm of said lever; and said second button is a slide button fixedly connected to said second arm of said lever by means of a bracket member.

6. The power tool according to claim 5 wherein:

said bracket member is integrated in said housing and having a first end fixed to said second arm and a second end fixed to said slide button.

7. The power tool according to claim 2 wherein: said handle comprises a grip means extending in a substantially horizontal plane;

said trigger is protruding out of said housing on a inner side of said grip means;

said first unlocking means is located left to the trigger when looking on a rear side of the grip means; and said second unlocking means is located right to the power switch when looking on said rear side of the grip means.

8. A handle for a powered device having a lock-out mechanism for unlocking a lock mechanism ambidextrously by an operator, wherein the lock mechanism for preventing unintended actuation of a power switch, the handle comprising:

a first unlocking means located on the lock-out mechanism to be conveniently operated by a right hand; and a second unlocking means on the lock-out mechanism to be conveniently operated by a left hand;

both of said first and second unlocking means capable of unlocking said lock mechanism of the powered device in order to release the power switch and allow operation of the powered device.

9. The handle as claimed in claim 8 wherein the powered device is a miter saw having a grip means extending in a substantially horizontal plane.

* * * * *